US005718433A

United States Patent [19]

Lu et al.

[11] Patent Number: 5,718,433

[45] Date of Patent: Feb. 17, 1998

[54] CENTRAL SCORE BLOCK STRUCTURE FOR ELECTRONIC DART GAMES

[76] Inventors: Kuo-Hui Lu, 3F, No. 50, Lane 2, Sec. 2, Yan Jiow Yuann Rd., Taipei; Ching-Tai Yen, 4F, No. 11, Lane 474, Kang-Ning St., Hsi Chih, Taipei Hsien, both of Taiwan

[21] Appl. No.: 734,181

[22] Filed: Oct. 21, 1996

[51] Int. Cl.[6] ..... F41J 5/04

[52] U.S. Cl. ..... 273/374; 273/376

[58] Field of Search ..... 273/376, 374, 273/371

[56] References Cited

U.S. PATENT DOCUMENTS

| | | | |
|---|---|---|---|
| 4,586,716 | 5/1986 | Brejcha et al. | 273/376 |
| 5,116,063 | 5/1992 | Harlan et al. | 273/376 |
| 5,193,817 | 3/1993 | Pan | 273/376 |
| 5,275,418 | 1/1994 | Yiu | 273/376 |
| 5,482,291 | 1/1996 | Houriet, Jr. et al. | 273/376 |
| 5,486,007 | 1/1996 | Stewart et al. | 273/374 |
| 5,601,290 | 2/1997 | Yiu | 273/376 |

*Primary Examiner*—Mark S. Graham
*Attorney, Agent, or Firm*—Rabin, Champagne, & Lynt, P.C.

[57] ABSTRACT

An improved central score block structure for electronic dart games includes a primary score block corresponding to a double bull's eye, a secondary score block corresponding to a bull's eye, and a plurality of resilient elements for supporting respective urge posts of the score blocks. The secondary score block has a slightly tapered central hole having a flanged baffle ring at an outer end. The primary score block is inserted into the central hole of the secondary score block such that its front and rear ends are properly checked by the front and rear ends of the central hole while capable of free displacement therein. The primary score block and the secondary score block will individually respond to a dart hitting the respective rings represented thereby to display the correct score.

5 Claims, 5 Drawing Sheets

CENTRAL SCORE BLOCK STRUCTURE FOR ELECTRONIC DART GAMES

BACKGROUND OF THE INVENTION (a) Field of the Invention

The present invention relates generally to an improved central block structure for electronic dart games, and more particularly, to an improved structure in which a primary score block is movably inserted and positioned in a slightly tapered central hole of a secondary score block.

(b) Description of the Prior Art

In electronic dart games, scores are displayed and accumulated when a dart hits a certain ring causing a hit ring block to press downwardly to connect a specific circuit. However, the arrangement and structure of the conventional central score blocks, i.e., the double bull's eye and the bull's eye, are complicated. Therefore, there are disclosed various improvements on the prior art. One such invention is described in U.S. Pat. No. 5, 193,817 in which an annular board with a small hole, a hollow annular frame, and an annular board with a large hole constitute a central score block structure for the electronic dart game.

SUMMARY OF THE INVENTION

Accordingly, a primary object of the present invention is to provide an improved central score block structure for electronic dart games, in which a primary score block corresponding to the double bull's eye is inserted into a slightly tapered central hole of a secondary score block corresponding to the bull's eye, and resilient elements are disposed to support urge posts of the score blocks and enable the score blocks to automatically reset. The entire assembly is simple and quick to assemble, eliminating the need for any locking elements and ensuring smooth displacement of the primary score block.

Another object of the present invention is to provide an improved central score block structure for electronic dart games. A primary score block corresponding to the double bull's eye is a two-stepped block structure having a larger step portion at a rear end thereof, for baffling against a rear end of a slightly tapered central hole of a secondary score block, corresponding to the bull's eye, for reducing frictional resistance to ensure smooth displacement of the score blocks.

A further object of the present invention is to provide an improved central score block structure for electronic dart games, in which resilient elements are arranged to support urge posts of a primary score block and a secondary score block which respectively correspond to the double bull's eye and the bull's eye. The resilient elements are in the form of sponge, rubber pads or resilient springs to allow the score blocks to automatically reset.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
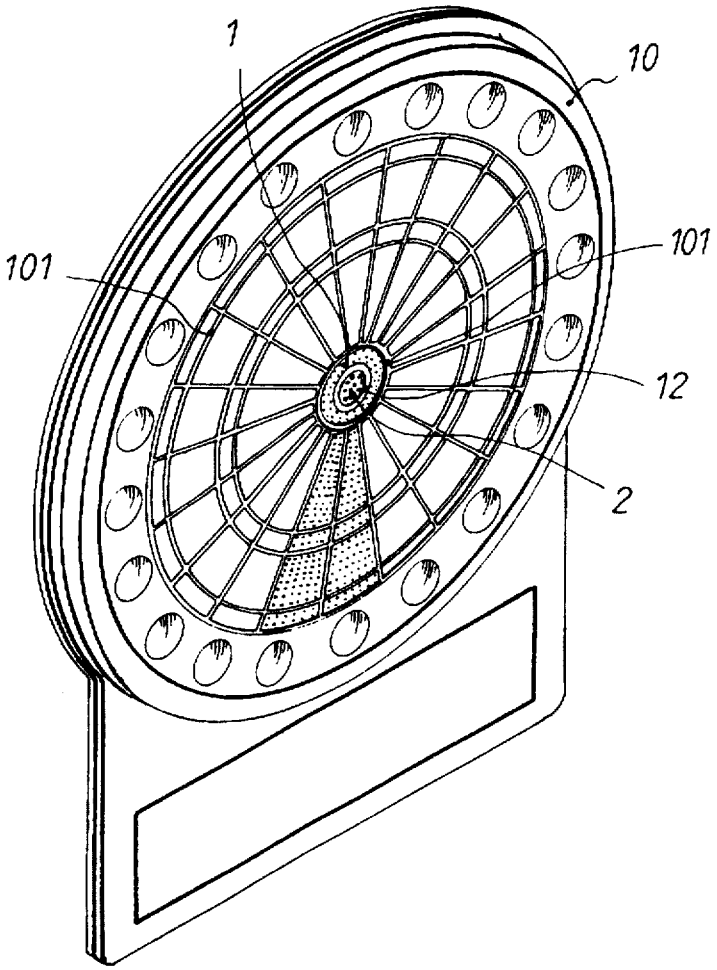
FIG. 1 is a perspective view of an electronic dart board according to the present invention.
Figure 2:
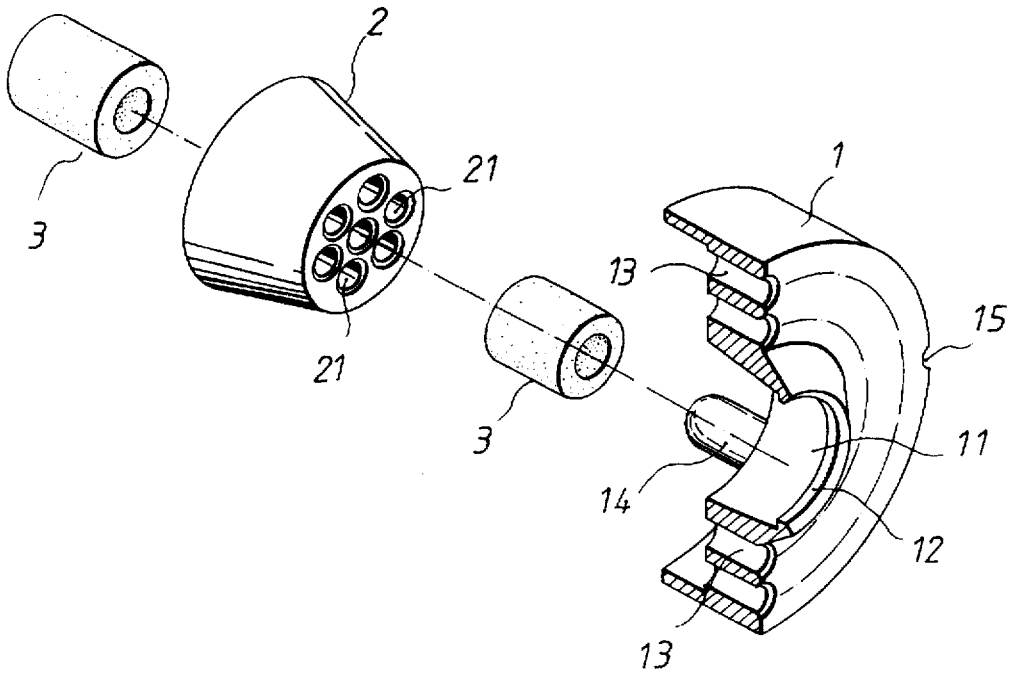
FIG. 2 is an elevational exploded view of a first preferred embodiment of the present invention.

With reference to FIG. 1, the improved central score block structure for electronic dart games to includes a primary score block 2 and a secondary score block 1, which to divide a central portion of a dart board 10 into a double bull's eye and a bull's eye, respectively. The present invention essentially comprises the primary score block 2 corresponding to the double bull's eye, the secondary score block 1 corresponding to the bull's eye, and a suitable number of resilient elements 3 (see FIG. 2).

The secondary score block 1 is insertably positioned on a central rib 101, and has a slightly tapered central hole 11. The central hole gradually enlarges from the outside to the inside. The size of the taper may be determined according to actual requirements. It should be noted that the size of the taper shown in the drawings is relatively large for the purposes of clearer illustration. The outer end of an inner wall of the central hole 11 forms a slightly tapered and flanged baffle ring 12. The outer surface is provided with a plurality of rings of dart holes 13, and an inner wall is provided with a plurality of upright urge posts 14.

Figure 3:
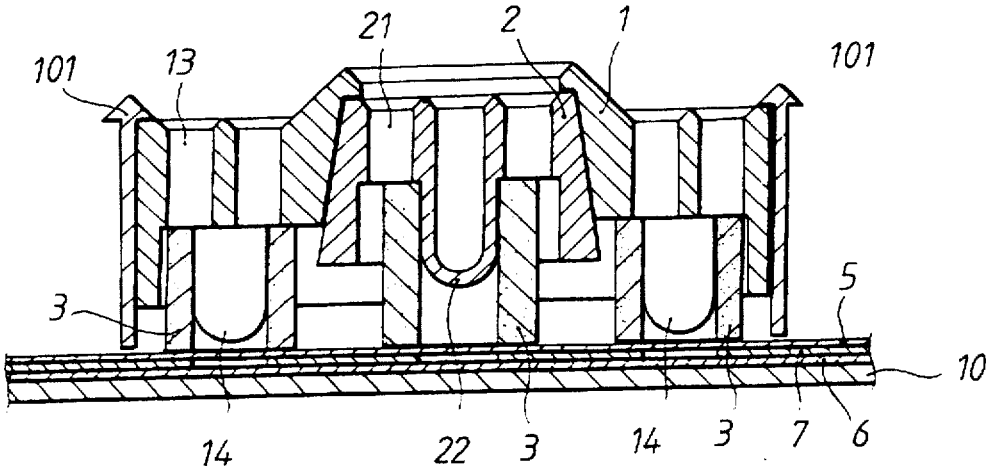
FIG. 3 is a sectional view of the first preferred embodiment of the present invention.
Figure 4:
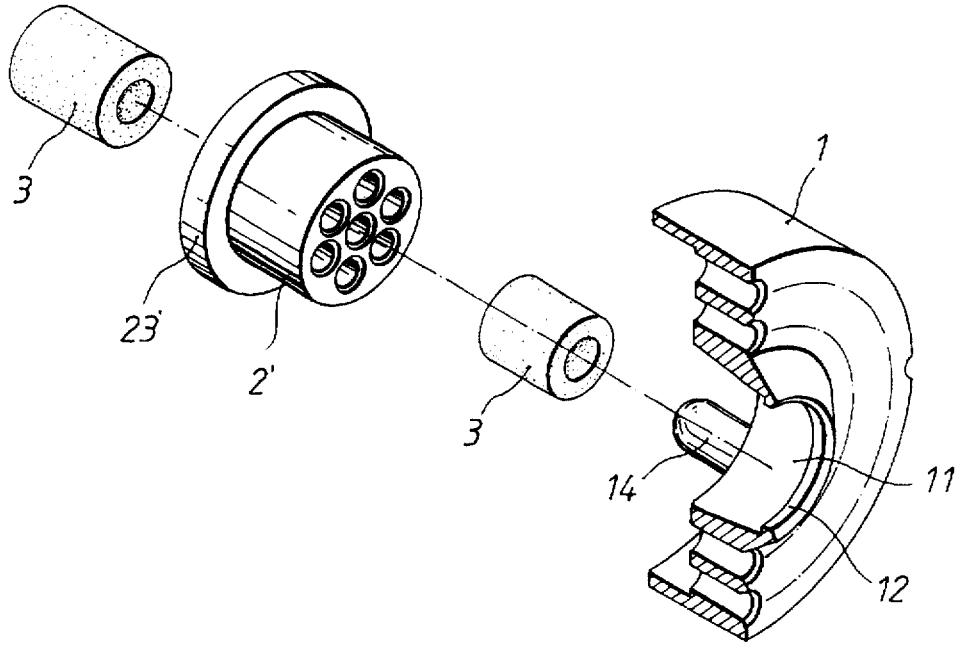
FIG. 4 is an elevational exploded view of a second preferred embodiment of the present invention.
Figure 5:
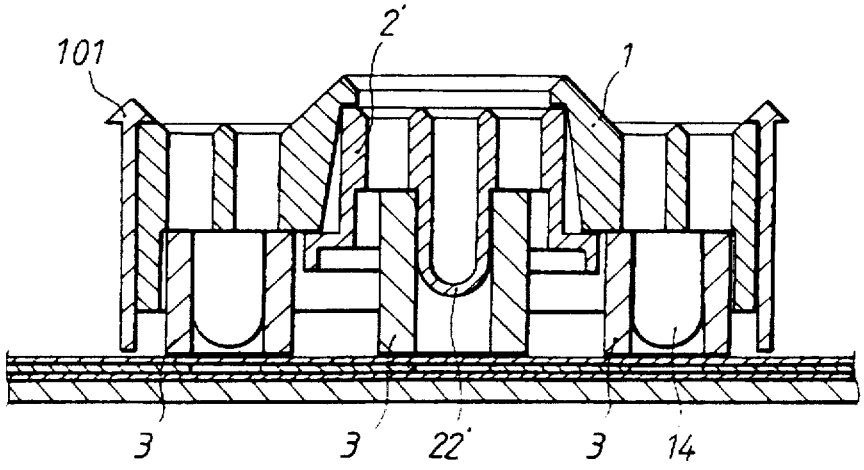
FIG. 5 is a sectional view of the second preferred embodiment of the present invention.

The primary score block 2 is also a slightly tapered block having a surface layer provided with a plurality of dart holes 21 and an urge post 22 disposed at the center of an inner wall thereof (see FIG. 3). Alternatively, the primary score block 2' may be configured to be a two-stepped block structure in which a larger step portion 23' is arranged at a rear end (see FIGS. 4 and 5).

The resilient elements 3 are arranged to provide support for the urge posts 14, 22 of the score blocks 1 and 2. Sponge, rubber pads, or resilient springs (preferably a spiral-shaped spring) may be adopted. If rubber pads are used, it is preferable that they are cup-shaped or flared. Various modifications and alternatives are obvious to those skilled in the art. Since such modifications or alternatives may be readily conceived, they are not illustrated in the drawings.

In assembly, the primary score block 2 is inserted into the central hole 11 of the secondary score block 1 via a rear end thereof of the latter. As a front end of the primary score block 2 is checked by the baffle ring 12, the primary score block 2 will not slip out via a front end of the central hole 11. And since the primary score block 2 is either tapered in shape with a large rear portion or is provided with a larger step portion 23', block 2 is movably retained in the central hole 11. Moreover, with the arrangement of the resilient elements 3, the primary score block 2 may generally urge against block 1 while positioned in the central hole 11 (see FIG. 3). The secondary score block 1, on the other hand, has its outer end wall just retained by the ribs 101, and is generally positioned by means of the resilient elements 3.

With the above-described arrangement, since the primary score block 2 is a slightly tapered block which is inserted via the rear end of the central hole 11 of the secondary score block 1, so as to be movably retained therein, its assembly is very simple and quick. Moreover, a single urge post 22 will be sufficient to enable the primary score block 2 to be movably urged against the central hole 11. There is no need to provide any other locking element. Further, since there is little frictional resistance between the central hole 11 and the primary score block 2, reciprocating displacement of the latter is very smooth. Additionally, resilient elements 3 are provided to suitably support the urge posts 14, 22 of the score blocks 1, 2. Resilient elements 3 enable the score blocks 1, 2 to automatically reset smoothly.

Furthermore, as the primary score block 2' may be designed to have a larger step portion 23' for stopping at the rear end of the central hole 11, very little frictional resistance, and hence smooth displacement of the primary score block 2', may be achieved.

Figure 6:
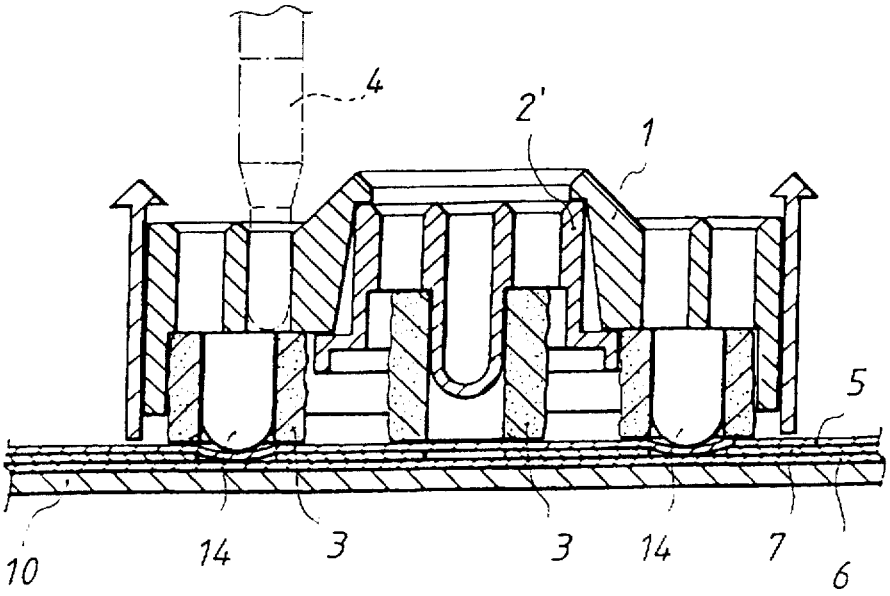
FIG. 6 is a cross-sectional view illustrating a dart hitting a secondary score block of the present invention.
Figure 7:
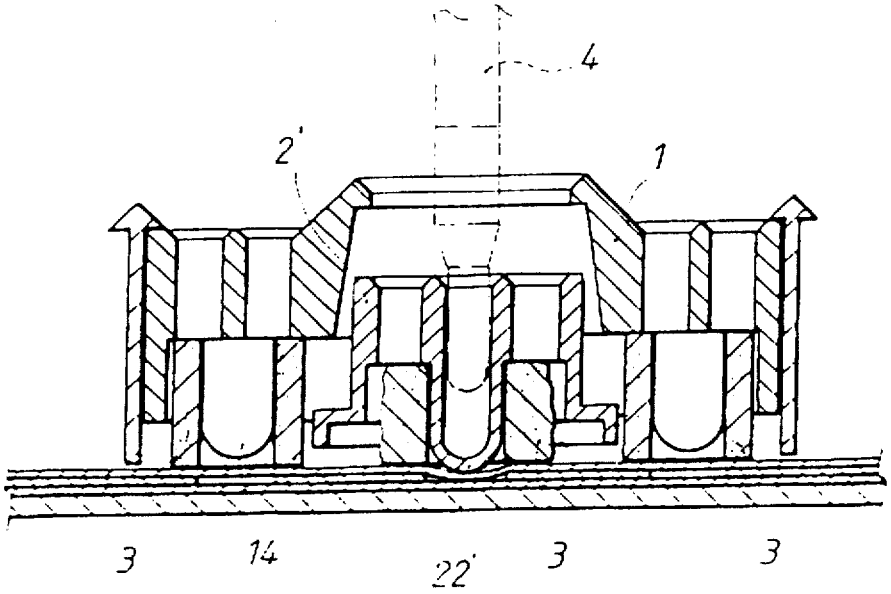
FIG. 7 is a cross-sectional view illustrating a dart hitting a primary score block of the present invention.

In use, if a dart 4 hits the area of the secondary score block 1 (see FIG. 6), both the primary score block 2' and the secondary score block 1 will press downwardly. The urge posts 14 of the secondary score block 1 will thus contact a specific circuit of an upper circuit board 5 and a lower circuit board 6. A partition 7 that is sandwiched therebetween, as is well known in the art, will make the connection and achieve the effects of score display and score accumulation. If the dart 4 hits the area of the primary score block 2', only the primary score block 2' will press downwardly, with its urge post 22' touching the specific circuit of the upper and lower circuit boards 5, 6 to obtain a display of the highest score.

In regard to the arrangement of the urge posts 14, 22 (22'), the urge post 22 of the primary score block 2 is arranged farther away from the upper and lower circuit boards 5, 6. Therefore, there will not be any interference if the dart 4 hits any of the score blocks 1, 2. In addition, both sides of the outer end wall of the secondary score block 1 are respectively provided with a curved indentation 15 which may engage a flange on an inner side of the central rib 101, so as to prevent the secondary score block 1 from rotating, thus ensuring proper contact between the urge posts and the specific circuit.

Figure 8:
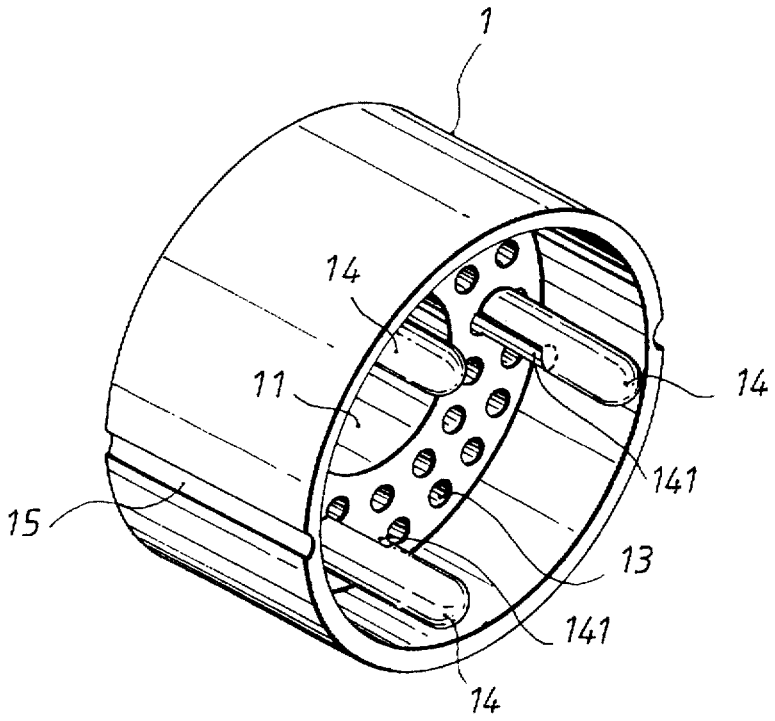
FIG. 8 is a perspective rear view of the secondary score block of the present invention.

In addition, as shown in FIG. 8, each urge post 14 of the secondary score block 1 is provided with an extended groove 141 at a portion overlapping with the dart hole 13, so that when the dart 4 hits the secondary score block 1, it will not be obstructed by the urge post 14, and, will be firmly held therein.

Although the present invention has been illustrated and described with reference to the preferred embodiments thereof, it should be understood that it is in no way limited to the details of such embodiments but is capable of numerous modifications within the scope of the appended claims.

What is claimed is:

1. An improved central score block structure for an electronic dart board having a central rib surrounding a bull's eye of the dart board, comprising:

a secondary score block corresponding to the bull's eye of the dart board, said secondary score block being insertably positionable inside of the central rib and having a surface layer provided with a plurality of radially-arranged dart holes, a wall surrounding the surface layer, a central hole extending through the surface layer and which gradually tapers in a direction towards the surface layer, a baffle ring surrounding the central hole and projecting beyond an outer end of the central hole, and a plurality of upright urge posts provided on an inner portion of said surface layer;

a primary score block corresponding to a double bull's eye of the dart board, and having a structure which is one of a tapered structure and a two-stepped block structure, said structure including a second surface layer provided with a plurality of radially-arranged central dart holes, and an urge post disposed at a center of an inner portion of said second surface layer; and a plurality of resilient elements for supporting said urge posts of said secondary score block and said primary score block; wherein said primary score block is inserted via a rear end of the central hole and into the central hole, such that a front end of said primary score block is movably baffled by said baffle ring, said resilient elements removably urging said primary score block against said secondary score block.

2. The improved central score block structure as claimed in claim 1, wherein said primary score block is the two-stepped block structure, with a larger step portion at a rear end thereof being movably checked at the central hole.

3. The improved central score block structure as claimed in claim 1, wherein said resilient elements include at least one of a sponge, rubber pads and resilient springs.

4. The improved central score block structure as claimed in claim 1, wherein said secondary score block is provided with a curved indentation at either side of an outer portion of said wall for engaging the central rib.

5. The improved central score block structure as claimed in claim 1, wherein each of said urge posts of said secondary score block is provided with an extended groove at a portion overlapping with a respective dart hole of said secondary score block so that a dart hitting said secondary score block may be firmly held therein.

* * * * *